US012551747B2

(12) United States Patent
Roriguez Rosa

(10) Patent No.: US 12,551,747 B2
(45) Date of Patent: Feb. 17, 2026

(54) WEIGHTLIFTING FACILITATOR STRAPS

(71) Applicant: Jose A Roriguez Rosa, Colorado Springs, CO (US)

(72) Inventor: Jose A Roriguez Rosa, Colorado Springs, CO (US)

(73) Assignee: José A. Rodríguez Rosa, Colorado Springs, CO (US)

( * ) Notice: Subject to any disclaimer, the term of this patent is extended or adjusted under 35 U.S.C. 154(b) by 96 days.

(21) Appl. No.: 18/489,740

(22) Filed: Nov. 19, 2023

(65) Prior Publication Data

US 2025/0161740 A1 May 22, 2025

(51) Int. Cl.

| | |
|---|---|
| ***A63B 21/00*** | (2006.01) |
| ***A63B 21/065*** | (2006.01) |
| ***A63B 21/072*** | (2006.01) |

(52) U.S. Cl.

CPC ..... *A63B 21/151* (2013.01); *A63B 21/065* (2013.01); *A63B 21/0724* (2013.01); *A63B 21/0726* (2013.01); *A63B 21/4035* (2015.10)

(58) Field of Classification Search

CPC ..... A63B 21/065; A63B 21/0724; A63B 21/0726; A63B 21/151; A63B 21/4035; A63B 21/4019; A63B 21/4021

See application file for complete search history.

(56) References Cited

U.S. PATENT DOCUMENTS

| | | | | |
|---|---|---|---|---|
| 5,096,190 | A * | 3/1992 | Montgomery | A63B 23/03508 482/108 |
| 5,624,359 | A * | 4/1997 | Dean | A61H 1/02 482/131 |
| 5,997,494 | A * | 12/1999 | Watkins | A61H 1/0218 602/32 |
| 8,043,197 | B2 * | 10/2011 | Hetrick | A63B 21/4043 482/904 |
| 8,944,976 | B2 * | 2/2015 | Crowell | A63B 21/00043 482/121 |
| 9,707,428 | B1 * | 7/2017 | Mitalski | A63B 21/068 |
| 10,695,603 | B1 * | 6/2020 | Lamping | A61H 3/00 |
| 11,213,713 | B2 * | 1/2022 | Bettini | A63B 21/151 |
| 11,311,763 | B2 * | 4/2022 | Yeates | A63B 21/018 |
| 11,369,831 | B2 * | 6/2022 | Beck | A63B 23/0482 |
| 11,872,440 | B1 * | 1/2024 | Paliwoda | A63B 21/4043 |
| 2007/0265145 | A1 * | 11/2007 | Teng | A63B 21/0023 482/907 |

(Continued)

*Primary Examiner* — Joshua Lee

(57) ABSTRACT

A weightlifting facilitator strap system, comprising a weightlifting facilitator strap that comprises a first section of handle openings, where a first handle opening of the first section of handle openings is associated with a first extremity of the weightlifting facilitator strap. The weightlifting facilitator strap system further includes a second section of handle openings, where a last handle opening of the second section of handle openings is associated with a second extremity of the weightlifting facilitator strap. The weightlifting facilitator strap system further includes a fastener section located between the first and second section of handle openings, where the fastener section includes a first loop adjacent to the first section of handle openings, a second loop adjacent to the second section of handle openings, and a fastener band located between the first loop and the second loop.

19 Claims, 7 Drawing Sheets

(56) References Cited

U.S. PATENT DOCUMENTS

| | | | | |
|---|---|---|---|---|
| 2008/0132392 | A1* | 6/2008 | Moulton | A63B 21/4023 482/122 |
| 2010/0062911 | A1* | 3/2010 | Stone | A63B 21/065 482/92 |
| 2011/0281699 | A1* | 11/2011 | Torres | A63B 23/12 482/131 |
| 2012/0322626 | A1* | 12/2012 | Meimaroglou | A63B 21/4021 482/92 |
| 2015/0031508 | A1* | 1/2015 | Goldberg | A63B 21/4035 482/106 |
| 2015/0306446 | A1* | 10/2015 | Spainhower | A63B 21/0726 482/106 |
| 2016/0023051 | A1* | 1/2016 | Lauener | A63B 21/1636 482/143 |
| 2022/0387844 | A1* | 12/2022 | Heard | A63B 21/4035 |
| 2024/0350862 | A1* | 10/2024 | Benjamin | A63B 21/0726 |

* cited by examiner

WEIGHTLIFTING FACILITATOR STRAPS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION

Technical Field of the Invention

The present disclosure relates to weightlifting equipment, and more particularly to a weightlifting facilitator strap system designed to secure dumbbells and provide multiple grip options for various exercises.

Description of Related Art

It is known to use various equipment to assist in weightlifting. Some known equipment includes work out gloves and resistance bands. However, prior equipment still caused strain to a user's hand, wrist and/or fingers and was not suitable to assist users with disabilities to be able to lift weights without overstaining the user's joints.

BRIEF DESCRIPTION OF THE SEVERAL VIEWS OF THE DRAWING(S)

DETAILED DESCRIPTION

A weightlifting facilitator strap (FIG. 1) is a strap designed to facilitate weightlifting of dumbbells by providing a system where the dumbbell is wrapped by a strap. The strap has a series of handle openings. Once the weight is secured to the straps, by hooking or looping itself around the dumbbell through the loop at each side of the self-fastener in the center or middle of the strap (FIG. 2) and by securing the self-fastener in the middle to the dumbbell handle for further stability (FIG. 3), the weight can be lifted by grabbing any level of the handle openings at each end of the weightlifting facilitator strap 100 (FIG. 4).

The handle openings (to lift the weight) can be grabbed or lifted with both hands (FIG. 4) using one hand at the same level on each opposite handle opening.

Figure 5:
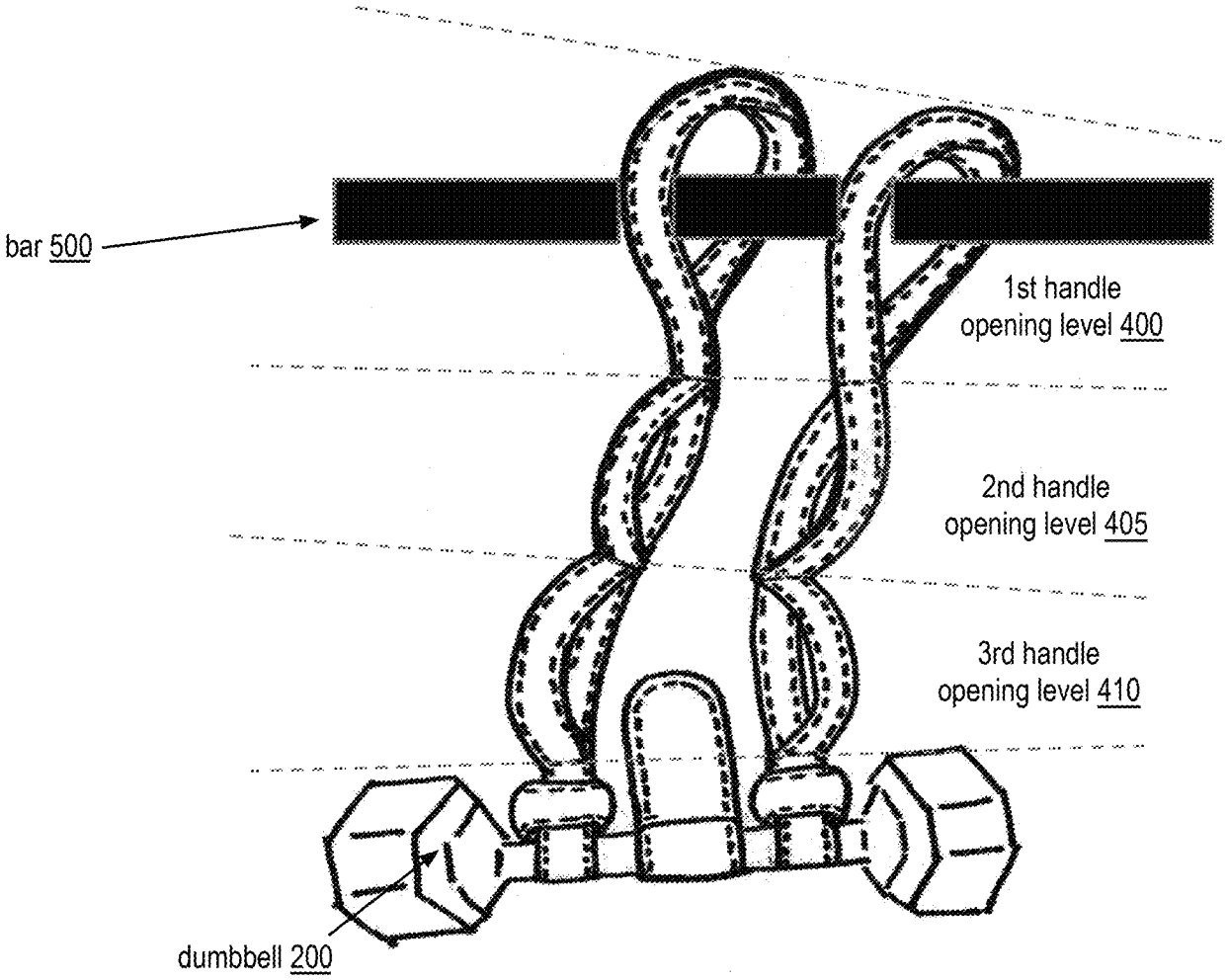
FIG. 5 illustrates an embodiment of a weightlifting facilitator strap attached to a dumbbell via loops and a fastener band and attached to a weightlifting bar in accordance with various embodiments.

Or the handle openings (to lift the weight) can be lifted by using an optional crossing bar through the same level of each opposite handle opening (FIG. 5).

Each side of the strap has a series of handle openings in the form of a chain to lift the weights. Each handle opening on one side of the dumbbell has a corresponding handle opening at the same level as the other side of the dumbbell. Each handle opening in the chain enlarges or makes shorter the distance between the hands or bar (whatever method is preferred) and the dumbbell.

Figure 6:
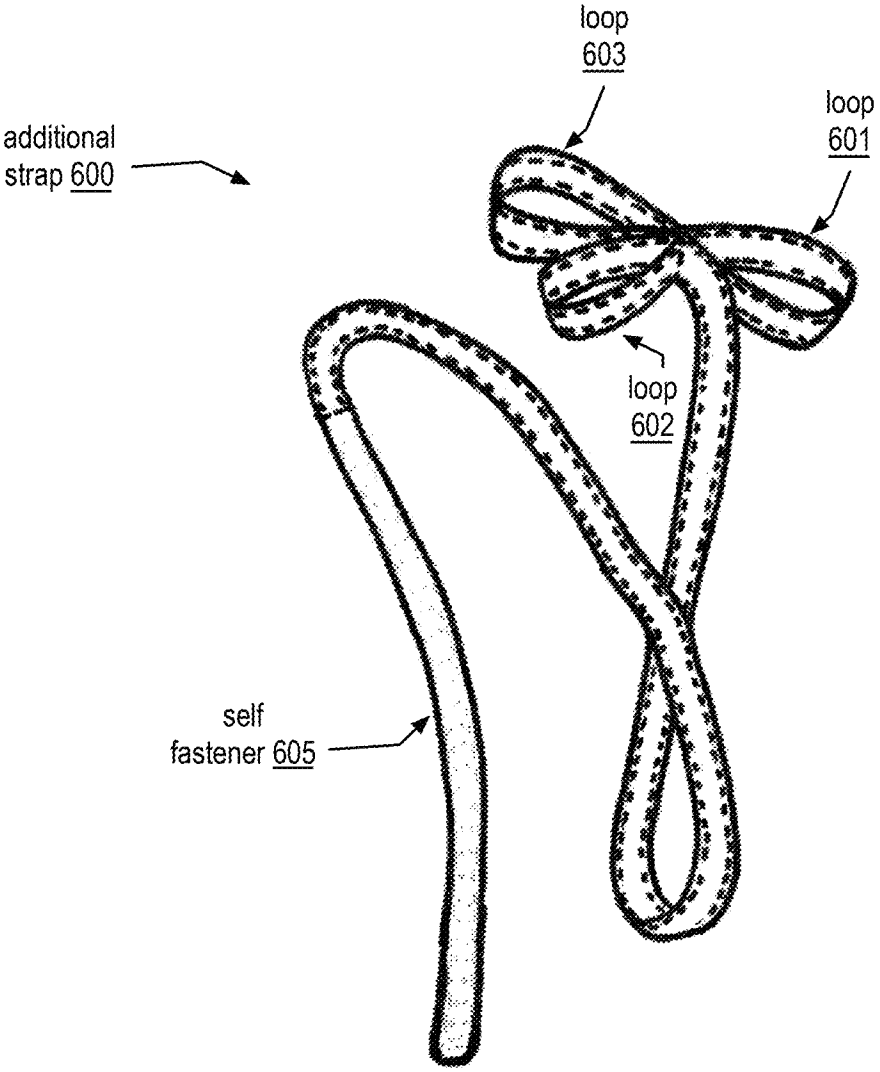
FIG. 6 illustrates an embodiment of an additional strap in accordance with various embodiments.
Figure 7:
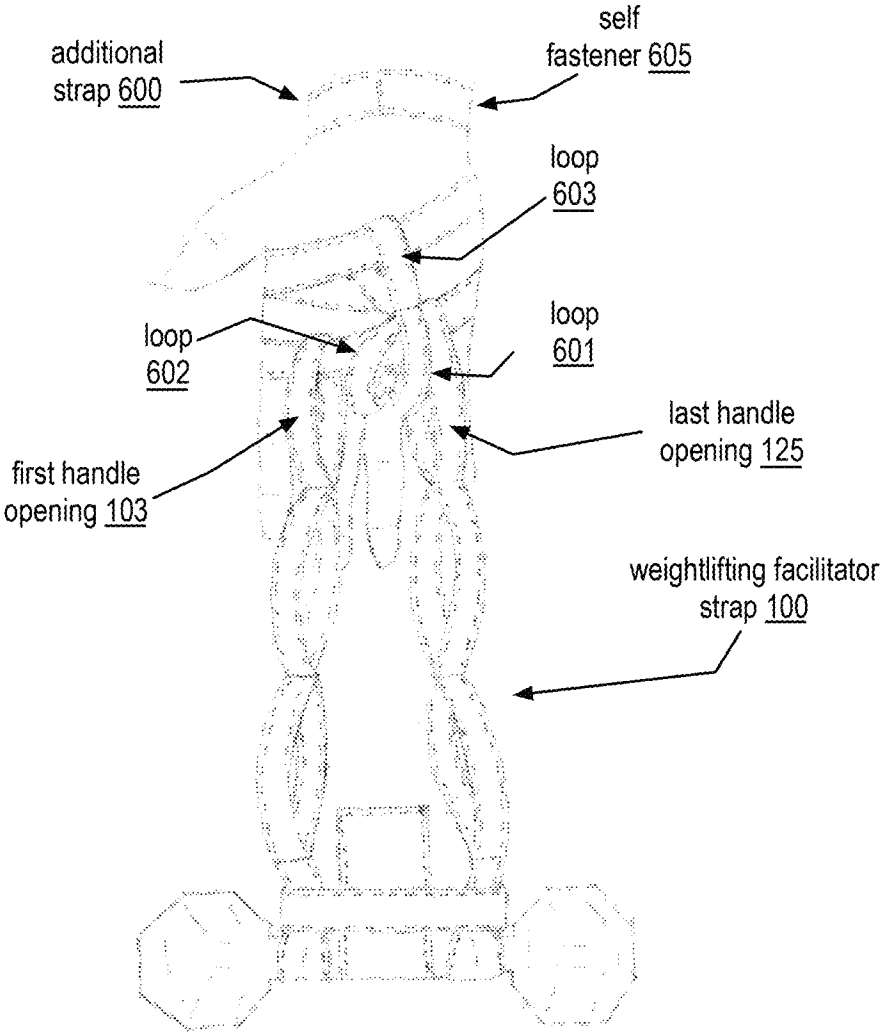
FIG. 7 illustrates an embodiment of the additional strap attached to users' wrist and hand and attached to a weightlifting facilitator strap in accordance with various embodiments.

Individuals with grasping problems in their hands can use another additional strap to interlock the handle openings and then wrap around the hands and wrist (FIG. 6). This band has at one extremity, a series of loops to secure the weightlifting facilitator strap to the hand and wrist. At the other extremity, the additional strap has self-fastener to secure the wrap around the wrist. FIG. 7 shows one configuration on how to secure the additional strap to the hand and wrist. This additional strap can be used in different configurations, for example, when wrapping the additional strap around the hand and/or wrist, a portion of the additional strap can be used over the thumb finger or under. These straps will benefit individuals in performing low to moderate weightlifting involving different body parts. People with problems on shoulders, hands, wrists, back and even in the knees may benefit because the system provides a way for weight leverage and weight distribution to facilitate the performance of multiple exercises using the right form.

Potential users can be weightlifters with arthritis, people that have join problems or suffer from inflammation or discomfort by using one hand or trying to lift by grasping the dumbbell bar itself.

Weightlifting is greatly facilitated by the weight distribution and balance the straps provide by themselves by attaching to a dumbbell. Additionally, a bar can be used through the handle openings or, any other optional or available connecting equipment can be used (i.e., additional straps, gym equipment, or any other weight resistance training equipment where the handle openings can be attached).

Characteristic features/specifications of the Weightlifting Facilitator Straps:

- Weightlifting Straps with levels composed of handle openings.
- Secure attachment to dumbbell by using loop and self-fastener method.
- Weightlifting Straps are non-elastic and non-stretching to provide balance and constant resistance.
- Allows the weight to be leveraged without too much straining on the hands and fingers.
- Help people to avoid over straining the joints or allow people with disabilities to lift some low or moderate weights.
- Can assist on the performance of multiple exercises involving dumbbell exercises.
- Can be used by lifting with hands, additional strap attached to hand or with an optional bar.
- Can be attached to other existing equipment.

Figure 1:
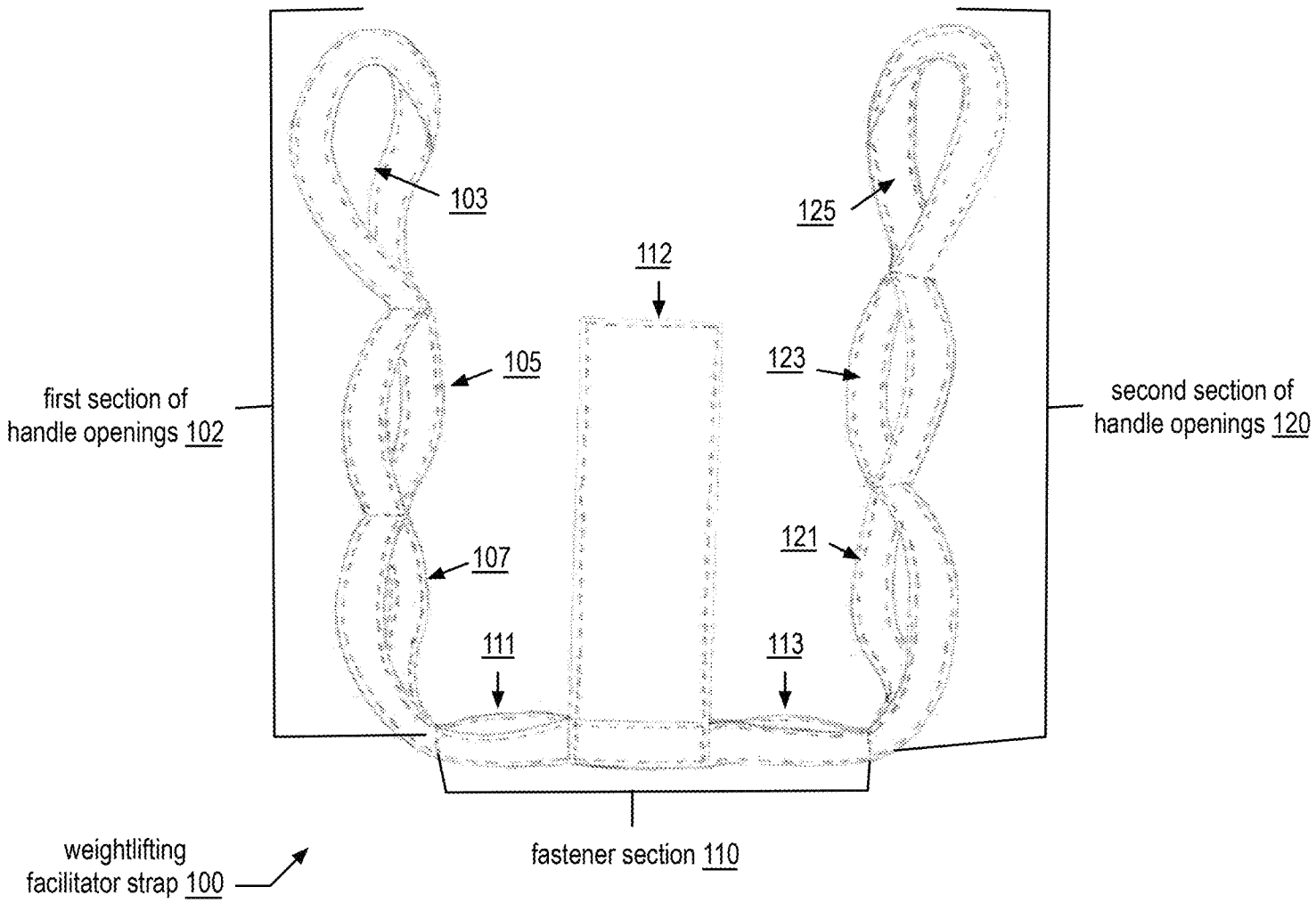
FIG. 1 illustrates an embodiment of a weightlifting facilitator strap in accordance with various embodiments.

FIG. 1 shows the front side of the weightlifting facilitator strap 100. No weight is attached. It shows three handle openings or loops 103-107 and 121-125 on each side raised up which form a first section of handle openings 102 and a second section of handle openings 120. In the middle of the weightlifting facilitator strap 100 is a fastener section 110 that includes a fastener band 112 that is adjacent to a first loop 111 and a second loop 113. The self-fastener band is shown in an unwrapped position.

Figure 2:
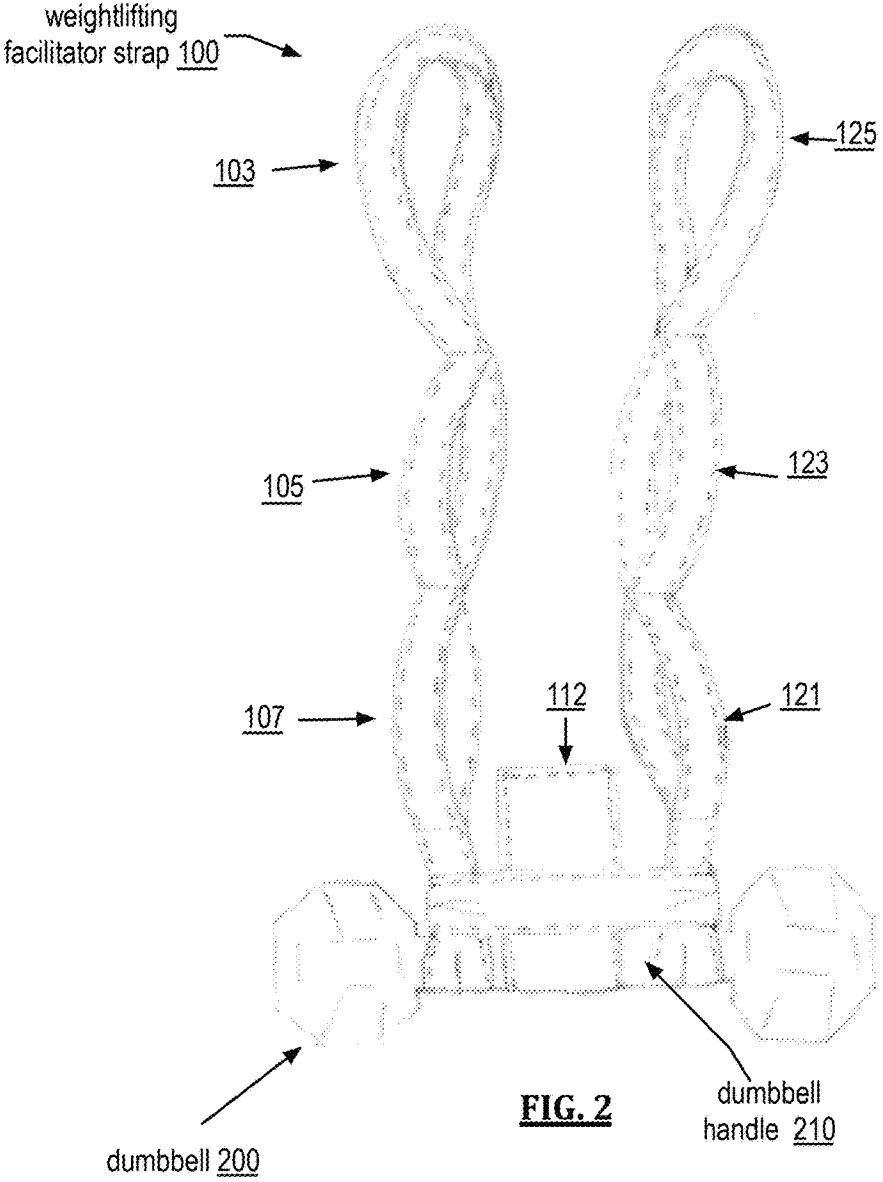
FIG. 2 illustrates an embodiment of a weightlifting facilitator strap attached to a dumbbell via loops in accordance with various embodiments.

FIG. 2 shows the weightlifting facilitator strap 100 secured to a dumbbell handle 210 of a dumbbell 200. Each side of the weightlifting facilitator strap 100 is wrapped around the dumbbell handle 210 and then it is inserted throughout the loops 111 and 113 at each side of the self-fastener band 112. This action secures the weightlifting facilitator strap 100 to the dumbbell handle 210. The self-fastener band 112 is unwrapped and not secured around itself in this figure.

Figure 3:
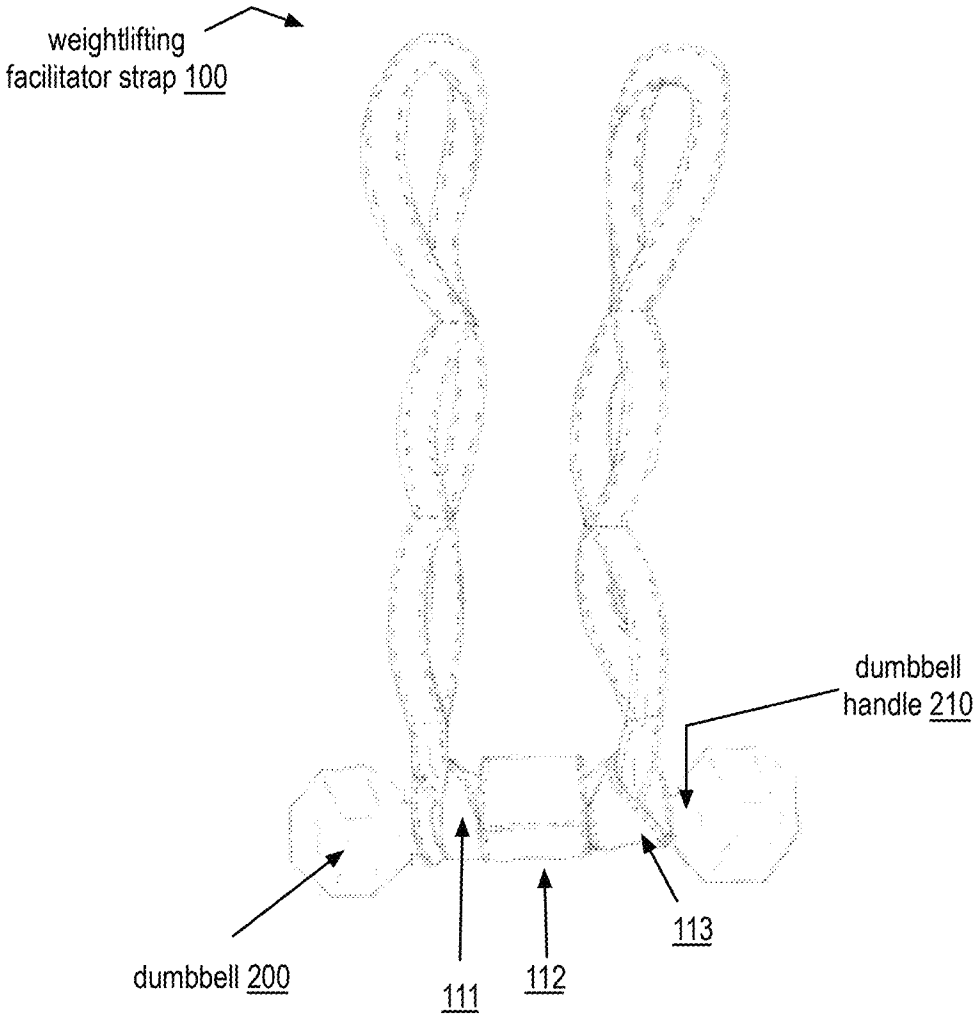
FIG. 3 illustrates an embodiment of a weightlifting facilitator strap attached to a dumbbell via loops and a fastener band in accordance with various embodiments.
Figure 4:
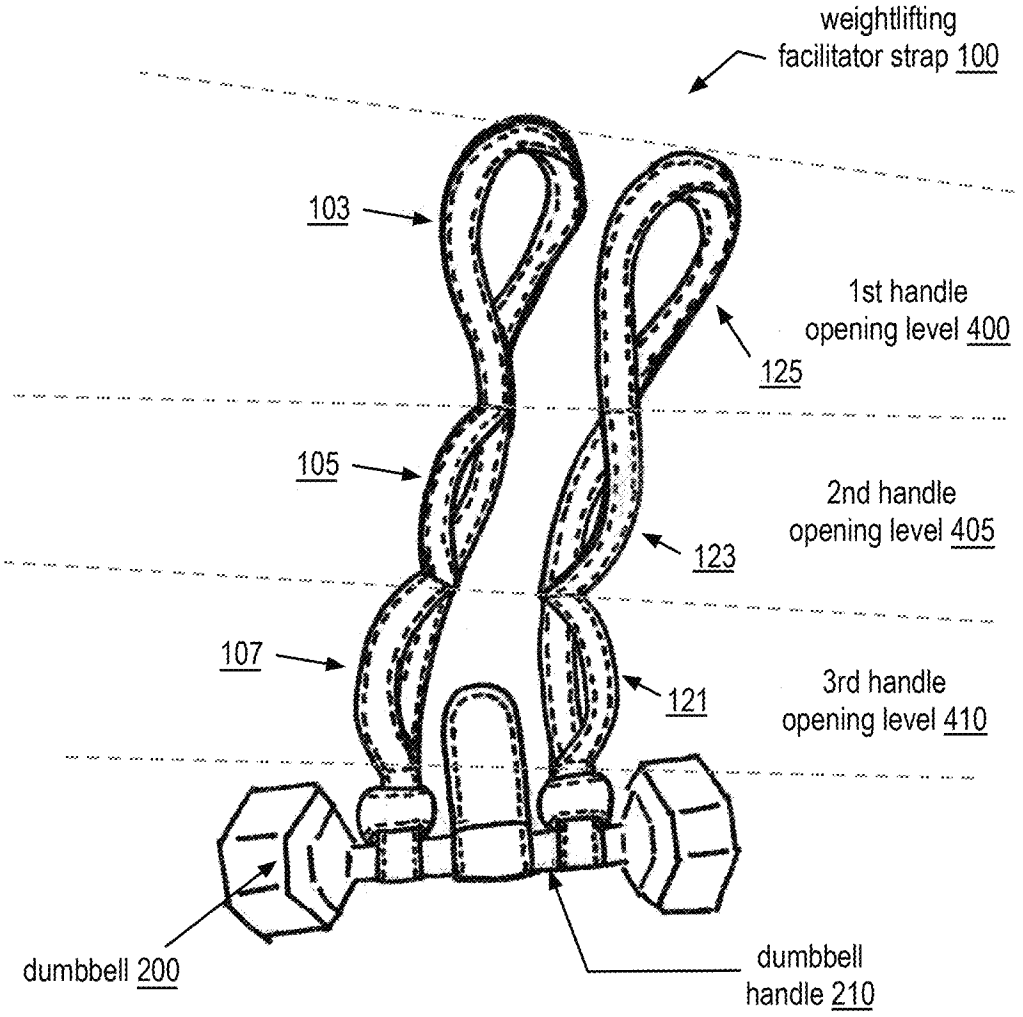
FIG. 4 illustrates another embodiment of a weightlifting facilitator strap attached to a dumbbell via loops and a fastener band in accordance with various embodiments.

FIG. 3 shows the weightlifting facilitator strap 100 secured to the dumbbell handle 210. Each side of the weightlifting facilitator strap 100 is wrapped around the dumbbell handle 210 and then it is inserted throughout the loops 111 and 113 at each side of the self-fastener band 112. This action secures the weightlifting facilitator strap 100 to the dumbbell handle 210. FIG. 2 also shows the self-fastener band 112 wrapped and secured around the dumbbell handle 210, providing more stability and security.

FIG. 4 shows two sections of three loops or handle openings 103-107 and 121-125 of the weightlifting facilitator strap 100 at each side of the dumbbell handle 210 that are used to lift the weighted dumbbell 200 by grabbing any corresponding handle opening from each side at the same handle opening level of handle opening levels 400, 405, and 410.

FIG. 5 shows an optional bar 500 inserted throughout the handle opening at the first handle opening level 400 of the weightlifting facilitator strap 100. In this setting, the dumbbell can be lifted by using this optional crossing bar 500. The bar can be inserted through any of the loops at the same level (e.g., $2^{nd}$ handle opening level 405, $3^{rd}$ handle opening level 410) to control the distance between the bar 500 and the weight (e.g., weighted dumbbell 200).

FIG. 6 shows an additional strap 600 (hand strap) that can be used as an optional attachment to the weightlifting facilitator strap 100. The additional strap 600 has three loops 601-603 on one side (e.g., extremity) of the strap and self-fastener 605 on the other side. The self-fastener 605 helps to secure the additional strap 600 around a user's wrist without excessive tying or pressure.

The additional strap 600 is intended to wrap around a user's hand and wrist. The additional strap 600 interlocks the loops 601-603 on the additional strap 600 with the handle openings 103-107 and 121-125 on the weightlifting facilitator strap 100. To accomplish this interlocking, the end of the additional strap 600 with the self-fastener 605 is inserted throughout the loops 601-603 on the opposite end of the additional strap 600 and through the certain ones of the handle openings 103-107 and 121-125 of the weightlifting facilitator strap 100, interlocking both straps 100 and 600, and then continue the motion by wrapping around the hand and wrist of the hand of the user. Once the loops 601-603 and handle openings 103-107 and 121-125 are interlocked and secured and the additional strap 600 is located around the wrist, the self-fastener 605 is used to lock or secure itself around the wrist. Self-fastener 605 is used to avoid any extra tying or pressure when a weight secured to the straps 100 and/or 600 is lifted and to easily release when finished.

FIG. 7 shows one configuration on how to fully assemble and interlock the weightlifting facilitator strap 100 to the additional strap 600 (hand strap) around a hand and wrist of a user. As shown, the additional strap 600 is wrapped around the hand then through the first loop 601, then through one of the loops of the weightlifting facilitator strap 100 (e.g., first handle opening 103), then throughout the other loop 602, and then through the last handle opening of the weightlifting facilitator strap 100.

The third loop 603 of the additional strap 600 is used to secure the additional strap 600 around the hand, and then wrap around the wrist and secure with the self-fastener 605. In some examples, the additional strap 600 can be used in different configurations. For example, in this figure a portion of the additional strap 600 inside the third loop 603 is used under the thumb finger. That same portion of the additional strap can be used over the thumb if it is preferred (not showed in the figure).

The invention claimed is:

1. A weightlifting facilitator strap system, comprising:

a weightlifting facilitator strap that comprises:

a first section of handle openings, wherein a first handle opening of the first section of handle openings is associated with a first extremity of the weightlifting facilitator strap;

a second section of handle openings, wherein a last handle opening of the second section of handle openings is associated with a second extremity of the weightlifting facilitator strap, and wherein the first extremity is on an opposite end of the weightlifting facilitator strap system than the second extremity; and a fastener section located between the first section of handle openings and the second section of handle openings, wherein the fastener section includes a first loop adjacent to the first section of handle openings, a second loop adjacent to the second section of handle openings, and a fastener band located between the first loop and the second loop, and wherein the weightlifting facilitator strap has a length based on a distance from the first extremity to the second extremity, wherein the weightlifting facilitator strap is configured to be attached to a weighted dumbbell by a first attachment loop that is formed by inserting the first extremity through the first loop, and wherein the weightlifting facilitator strap is further configured to be attached to the weighted dumbbell by a second attachment loop that is formed by inserting the second extremity through the second loop.

2. The weightlifting facilitator strap system of claim 1, wherein the first section of handle openings has the first handle opening, a second handle opening adjacent to the first handle opening, and a third handle opening adjacent to the second handle opening.

3. The weightlifting facilitator strap system of claim 2, wherein the third handle opening is adjacent to the first loop.

4. The weightlifting facilitator strap system of claim 3, wherein the second section of handle openings has the last handle opening, a second handle opening adjacent to the last handle opening, and a third handle opening adjacent to the second handle opening.

5. The weightlifting facilitator strap system of claim 4, wherein the third handle opening is adjacent to the second loop.

6. The weightlifting facilitator strap system of claim 1, wherein the second section of handle openings has the last handle opening, a second handle opening adjacent to the last handle opening, and a third handle opening adjacent to the second handle opening.

7. The weightlifting facilitator strap system of claim 6, wherein the third handle opening is adjacent to the second loop.

8. The weightlifting facilitator strap system of claim 1, wherein the fastener band is located substantially equidistant from the first extremity and the second extremity.

9. The weightlifting facilitator strap system of claim 1, wherein when the weightlifting facilitator strap system is positioned in a substantially straight line along the length, and when the fastener band is in an extended state, the fastener band extends outward from the fastener section in a direction that is substantially perpendicular to the substantially straight line.

10. The weightlifting facilitator strap system of claim 1, wherein when the fastener section is securely attached to a weighted dumbbell, a first section length of the first section remains substantially constant when the first section is under load from the weighted dumbbell.

11. The weightlifting facilitator strap system of claim 10, and wherein a second section length of the second section remains substantially constant when the second section is under the load from the weighted dumbbell.

12. The weightlifting facilitator strap system of claim 10, wherein a handle opening of the first section of handle openings has an interior circumference, and wherein the interior circumference is at least a first size such that a weightlifting bar can be inserted through the handle opening.

13. The weightlifting facilitator strap system of claim 12, wherein a second handle opening of the second section of handle openings has a second interior circumference, and wherein the second interior circumference is at least the first size such that the weightlifting bar can be inserted through the second handle opening.

14. The weightlifting facilitator strap system of claim 1, wherein a handle opening of the first section of handle openings and a second handle opening of the second section of handle openings are configured to be attached to one or more of an additional strap, gym equipment, and other weight resistance training equipment.

15. The weightlifting facilitator strap system of claim 1, wherein the weightlifting facilitator strap is further attached to the weighted dumbbell by wrapping the fastener band around a handle of the weighted dumbbell.

16. The weightlifting facilitator strap system of claim 1, wherein the weightlifting facilitator strap is made of a non-elastic material.

17. The weightlifting facilitator strap system of claim 1 further comprising:

an additional strap having a series of loops disposed on a first extremity of the additional strap, and having a self-fastener disposed at a second extremity of the additional strap.

18. The weightlifting facilitator strap system of claim 17, wherein the additional strap is configured to be connected to the first section and the second section by inserting the second extremity through a handle opening of the first section and a second handle opening of the second section.

19. The weightlifting facilitator strap system of claim 18, wherein the self-fastener is configured to secure the additional strap to a hand and a wrist of a user.

* * * * *